US009540768B2

(12) United States Patent
Higuchi et al.

(10) Patent No.: US 9,540,768 B2
(45) **Date of Patent: *Jan. 10, 2017**

(54) SHEET MANUFACTURING APPARATUS

(71) Applicant: SEIKO EPSON CORPORATION, Tokyo (JP)

(72) Inventors: Naotaka Higuchi, Fujimi-machi (JP); Shigeo Fujita, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/635,103

(22) Filed: Mar. 2, 2015

(65) Prior Publication Data

US 2015/0252530 A1 Sep. 10, 2015

(30) Foreign Application Priority Data

Mar. 7, 2014 (JP) ..... 2014-044766

(51) Int. Cl.
*D04H 1/732* (2012.01)
*D21F 2/00* (2006.01)
*D21F 1/52* (2006.01)

(52) U.S. Cl.
CPC ..... *D21F 2/00* (2013.01); *D04H 1/732* (2013.01); *D21F 1/526* (2013.01)

(58) Field of Classification Search
CPC ..... D04H 13/00; D04H 1/492; D04H 1/732; D21F 1/526; D21F 2/00; B65H 2801/84; D01G 25/00; D21B 1/06
USPC ..... 162/252, 272, 363–374; 19/296
See application file for complete search history.

(56) References Cited

U.S. PATENT DOCUMENTS 3,765,971 A * 10/1973 Fleissner ..... D04H 1/00 156/104
4,142,661 A 3/1979 Nettles et al.
4,366,025 A * 12/1982 Gordon, Jr. ..... D21F 3/105 100/118
4,417,931 A * 11/1983 Li ..... B27N 3/10 156/209
4,668,322 A * 5/1987 Christensen ..... B31F 1/07 156/209
4,809,404 A * 3/1989 Lasenga ..... D04H 1/44 19/106 R (Continued)

FOREIGN PATENT DOCUMENTS

CN 104894904 A * 9/2015 ..... D21F 1/526
JP 2006-525435 A 11/2006

*Primary Examiner* — Jose Fortuna
(74) *Attorney, Agent, or Firm* — Global IP Counselors, LLP

(57) ABSTRACT

A sheet manufacturing apparatus includes: a first transport unit that causes a first transport belt to circle around so as to transport a web containing a fiber; and a second transport unit that is disposed with a part thereof shifted from the first transport unit toward the downstream side in a transport direction of the web, sucks the web in a direction in which the web is spaced from the first transport belt, and transports the web. The second transport unit includes a suction unit that generates a suction force and a suction chamber which is positioned on an inner side of a second transport belt circling around and of which an inner space is sucked by the suction unit such that the web is adsorbed onto the second transport belt. A part of the suction chamber faces the first transport belt.

8 Claims, 5 Drawing Sheets

(56) References Cited

U.S. PATENT DOCUMENTS 5,414,902 A * 5/1995 Kroyer ..... D21B 1/06 19/305
5,730,440 A 3/1998 Motooka
5,741,402 A * 4/1998 Trokhan ..... D21F 1/52 162/306
6,141,833 A * 11/2000 Sorense ..... D01G 25/00 19/161.1
6,375,773 B1 * 4/2002 Andersen ..... D04H 1/12 156/148
7,331,089 B2 * 2/2008 Christensen ..... D04H 1/492 19/296
7,942,406 B2 5/2011 Ootaki
8,763,219 B2 * 7/2014 Jonsson ..... D04H 1/4374 28/104
9,328,461 B2 * 5/2016 Fujita ..... D21F 9/00
2002/0168910 A1 * 11/2002 Vuillaume ..... D04H 3/11 442/381
2003/0217448 A1 * 11/2003 Andersen ..... B32B 5/26 28/104
2005/0091811 A1 * 5/2005 Billgren ..... D04H 5/02 28/104
2005/0148261 A1 * 7/2005 Close ..... A61K 8/0208 442/381
2006/0008621 A1 * 1/2006 Gusky ..... D04H 1/00 428/156
2014/0027075 A1 * 1/2014 Yamagami ..... D21B 1/08 162/4
2014/0374047 A1 * 12/2014 Yamagami ..... D21B 1/08 162/261
2015/0096701 A1 * 4/2015 Higuchi ..... B02C 4/10 162/261
2015/0096702 A1 * 4/2015 Higuchi ..... D21D 5/24 162/261
2015/0096703 A1 * 4/2015 Fujita ..... B65H 29/125 162/286
2015/0096705 A1 * 4/2015 Fujita ..... D21F 9/00 162/348
2015/0238062 A1 * 8/2015 Baker ..... A47L 13/16 15/223
2015/0240417 A1 * 8/2015 Higuchi ..... D21B 1/06 162/261
2015/0251867 A1 * 9/2015 Higuchi ..... B65H 20/10 226/95
2015/0252530 A1 * 9/2015 Higuchi ..... D21F 2/00 162/363
2015/0275429 A1 * 10/2015 Higuchi ..... D21F 11/00 162/261
2015/0275430 A1 * 10/2015 Higuchi ..... D21F 9/04 162/261

* cited by examiner

SHEET MANUFACTURING APPARATUS

BACKGROUND

1. Technical Field

The present invention relates to a sheet manufacturing apparatus.

2. Related Art

JP-T-2006-525435 discloses that a suction box is provided in an enclosure of a transfer wire of an apparatus for forming, in a dry way, a cloth material formed of two sheets of nonwoven fabric.

Since a tip-end portion of a web which is used for forming a sheet is formed to be thin during shaping of a sheet, it is difficult to suck and peel off a tip end of the web. In addition, when suction of the tip end of the web is performed, the suction is performed in a space where the web is not present and thus it is not possible to suck the tip end of the web in some cases.

SUMMARY

The invention can be realized in the following forms or application examples.

(1) According to an aspect of the invention, a sheet manufacturing apparatus that forms a sheet using a web includes: an accumulation unit that accumulates a web containing at least a fiber on a first transport belt; a first transport unit that causes the first transport belt to circle around so as to transport the web; and a second transport unit that is spaced from the first transport unit in a direction perpendicular to a surface of the web, is disposed with a part thereof shifted from the first transport unit toward the downstream side in a transport direction of the web, and sucks the web in a direction in which the web is spaced from the first transport belt and transports the web. The second transport unit includes a suction unit that generates a suction force, a second transport belt that circles around, and a suction chamber which is positioned in an inner side of the second transport belt circling around and of which an inner space is sucked by the suction unit such that the web is adsorbed onto the second transport belt. A part of the suction chamber faces the first transport belt.

In the sheet manufacturing apparatus, since the suction chamber that sucks the web is disposed at a position facing the first transport belt on which the web is accumulated and which transports the web, a tip-end portion of the web on the first transport belt is likely to be adsorbed onto the second transport belt.

(2) The sheet manufacturing apparatus according to the aspect of the invention may further include a supplementary member that is disposed at a position which faces and is spaced from a surface of the second transport unit at which suction of the web is performed, on which the suction force has an influence, and which is spaced farther from the surface than a thickness of the web, on the downstream side from the first transport unit in the transport direction of the web.

In the sheet manufacturing apparatus, the supplementary member is provided at the position on which the suction force of the second transport unit has an influence on the downstream side from the first transport unit and thus, an amount of air intake is decreased in a zone in which the supplementary member is provided and static pressure applied to the web on the first transport belt is increased in a zone facing the suction chamber. Therefore, the tip-end portion of the web on the first transport belt is likely to be adsorbed onto the second transport belt.

(3) In the sheet manufacturing apparatus according to the aspect of the invention, the supplementary member may be greater in size than the suction chamber along the surface of the web in a direction orthogonal to the transport direction of the web.

In the sheet manufacturing apparatus, since an amount of air intake is greatly decreased in a zone in which the supplementary member is provided, the tip-end portion of the web on the first transport belt is likely to be adsorbed onto the second transport belt. In addition, even in a case where the apparatus stops and there is no suction force during transporting the web, it is possible to receive the web having been peeled off from the second transport belt by the supplementary member.

(4) In the sheet manufacturing apparatus according to the aspect of the invention, the suction chamber may have a plurality of holes on a surface facing the first transport unit, and the holes on the upstream side may be greater in size than the holes on the downstream side in the transport direction of the web.

In the sheet manufacturing apparatus, the plurality of holes are provided on the surface of the suction chamber which faces the first transport unit and the hole on the upstream side is greater in size than the holes on the downstream side. In this way, an amount of air intake on the downstream side is decreased and static pressure applied to the web on the first transport belt is increased on the upstream side. Therefore, the tip-end portion of the web on the first transport belt is likely to be adsorbed onto the second transport belt.

(5) In the sheet manufacturing apparatus according to the aspect of the invention, the suction chamber may be divided into a plurality of suction regions in the transport direction of the web, the suction of the suction regions may be controllable separately, and, when the transport of the web is started, the suction may be started earlier in the suction region farther on the upstream side in the transport direction of the web than in the suction region farther on the downstream side.

In the sheet manufacturing apparatus, the suction chamber is divided into a plurality of suction regions, control is performed such that, when the transport of the web is started, the suction is first started in the suction region on the upstream side. In this way, it is possible for the tip-end portion of the web to be reliably adsorbed onto the second transport belt when the transport of the web is started.

(6) In the sheet manufacturing apparatus according to the aspect of the invention, a plurality of the suction units may be connected to the plurality of suction regions, respectively and, when the transport of the web is started, the suction may be started earlier by the suction unit corresponding to the suction region farther on the upstream side in the transport direction of the web than by the suction unit corresponding to the suction region farther on the downstream side.

In the sheet manufacturing apparatus, the plurality of the suction units are connected to the plurality of suction regions, respectively and, when the transport of the web is started, control is performed such that the suction unit corresponding to the suction region on the upstream side starts to perform the suction earlier. In this way, it is possible for the tip-end portion of the web to be reliably adsorbed onto the second transport belt when the transport of the web is started.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a preferred embodiment of the invention will be described with reference to the drawings. The details of the invention described in the claims are not inappropriately limited to the embodiments to be described below. In addition, the entire configurations to be described below are not the essential requirements of the invention.

1. Configuration

Figure 1:
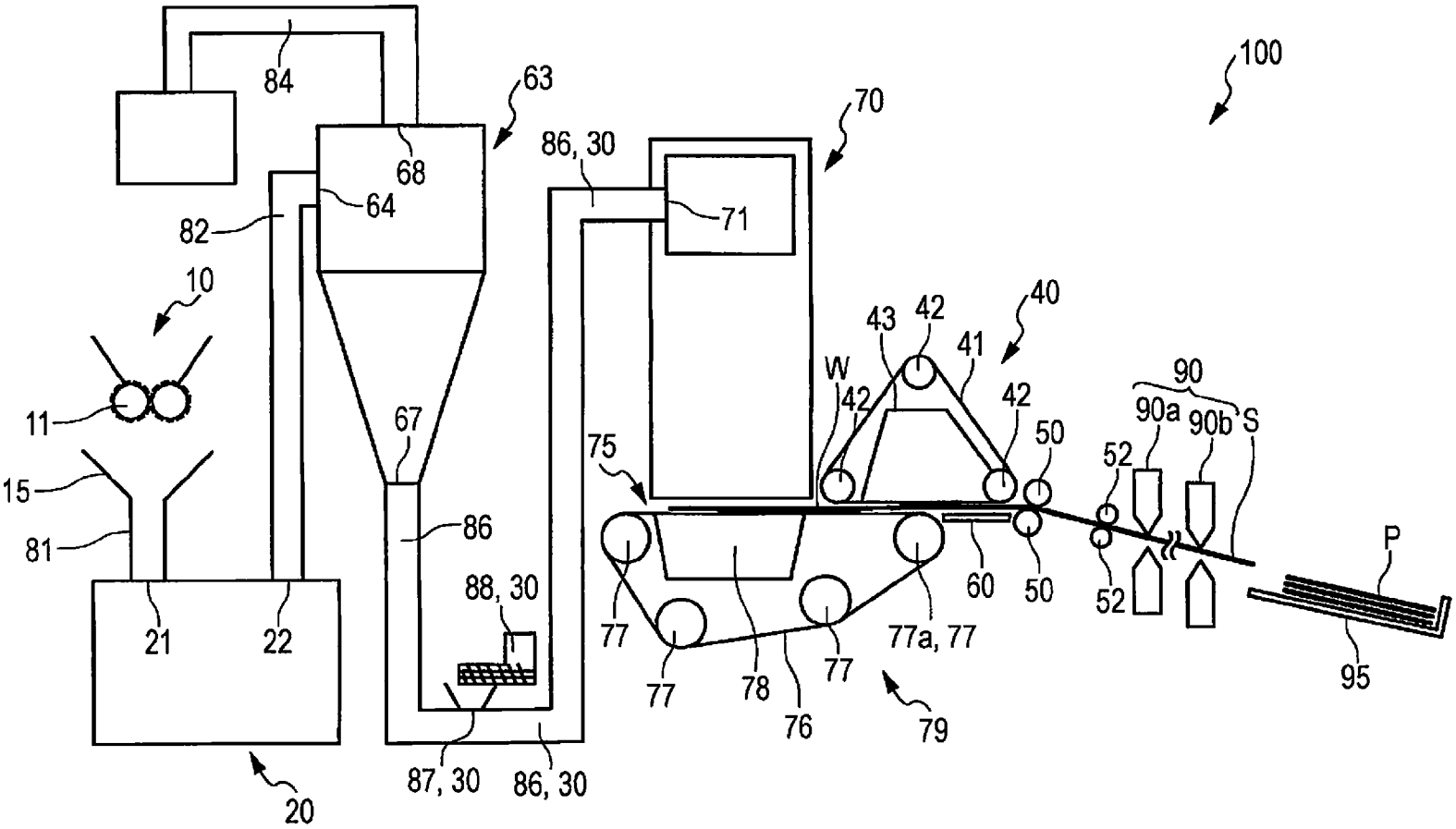
FIG. 1 is a view schematically illustrating a sheet manufacturing apparatus according to an embodiment.

FIG. 1 is a view schematically illustrating a sheet manufacturing apparatus 100 according to an embodiment. As illustrated in FIG. 1, the sheet manufacturing apparatus 100 includes a crushing unit 10, a defibrating unit 20, a classification unit 63, a mixing unit 30, a disentanglement unit 70, an accumulation unit 75, a first transport unit 79, a second transport unit 40, a pressurizing unit 50, a heating unit 52, and a cutting unit 90.

The crushing unit 10 cuts (crush), in the air, a raw material (source material) such as a pulp sheet or paper (for example, A4-size waste paper) put therein into strips. A shape or size of the strip is not particularly limited; however, the strip forms a quadrangle of several centimeters. In an example illustrated in the drawings, the crushing unit 10 has a crushing blade 11 and it is possible to cut the raw material put in by the crushing blade 11. The crushing unit 10 may be provided with an automatic put-in section (not illustrated) for continuously putting in the raw material.

The strip cut by the crushing unit 10 is received in a hopper 15 and then, is transported to the defibrating unit 20 via a pipe 81. The pipe 81 communicates with a guiding-in opening 21 of the defibrating unit 20.

The defibrating unit 20 defibrates the strip (defibration object). The defibrating unit 20 generates fibers fibrillated in a fiber shape through the defibrating process of the strip.

Here, the term "defibrating process" indicates the refining of the strip (defibration object) of a plurality of bonded fibers into individual fibers. The term "defibrated material" indicates the material that has passed through the defibrating unit 20. The term "defibrated material" also includes resin particles (resin for mutual bonding of a plurality of fibers) and ink particles of inks, toners, and blur-preventing agents when the fibers are refined, in addition to the refined fibers. In the following description, the "defibrated material" is at least a part of materials that passed through the defibrating unit 20 and may be mixed with a substance that is added after passing through the defibrating unit 20.

The defibrating unit 20 separates resin particles, or ink particles such as ink, toner, or a blur preventing material which are attached to the strip from the fiber. Along with the defibrated material, the resin particles and the ink particles are discharged from a discharge opening 22. The defibrating unit 20 performs the defibrating process on the strip guided in through the guiding-in opening 21 using a rotating blade. The defibrating unit 20 defibrates in a dry type system in the atmosphere (in air).

It is preferable that the defibrating unit 20 has a mechanism for producing an air current (airflow). In this case, the defibrating unit 20 generates an air current and uses the generated air current to draw in the defibration object from the guiding-in opening 21, defibrates, and transfers the defibrated material to the discharge opening 22. The defibrated material discharged from the discharge opening 22 is guided into the classification unit 63 via a pipe 82. In a case where the defibrating unit 20 which does not have an air current generating mechanism is used, a mechanism that generates an air current for introducing the strip to the guiding-in opening 21 may be provided externally.

The classification unit 63 separates and removes the resin particles and the ink particles from the defibrated material. As the classification unit 63, an air current type classifier is used. The air current type classifier produces a swirling air current and performs separation by a centrifugal force and a size or density of a substance to be classified such that it is possible to adjust a classification point by adjusting a speed or centrifugal force of the air current. Specifically, a cyclone, an Elbow-jet, an eddy classifier, or the like is used as the classification unit 63. Particularly, since the cyclone has a simple structure, it is possible for the cyclone to be appropriately used as the classification unit 63. Hereinafter, a case of using the cyclone as the classification unit 63 will be described.

The classification unit 63 has at least a guiding-in opening 64, a lower discharge opening 67 provided in the lower portion, and an upper discharge opening 68 provided in the upper portion. In the classification unit 63, an air current containing the defibrated material guided in from the guiding-in opening 64 is caused to move in a circling motion and thereby, the centrifugal force is applied to the defibrated material guided in such that the fiber material (fibrillated fiber) is separated from waste (resin particles and ink particles) which is lower in density than the fiber material. The fiber material is discharged from the lower discharge opening 67 and is guided into a guiding-in opening 71 of the disentanglement unit 70 through a pipe 86. The waste is discharged to the outside of the classification unit 63 from the upper discharge opening 68 through a pipe 84.

It is described that the fiber material is separated from the waste by the classification unit 63; however, the separation is not performed with accuracy. In some cases, a relatively small fiber material or a fiber material with low density is discharged to the outside along with the waste. In addition, in some cases, waste with relatively high density or waste entangled with the fiber material is guided into the disentanglement unit 70 along with the fiber material. In this application, a substance discharged from the lower discharge opening 67 (substance having a higher ratio of long fibers than waste) is referred to as the "fiber material". A substance discharged from the upper discharge opening 68 (substance having a lower ratio of long fibers than a fiber material) is referred to as the "waste". In a case where the raw material is not waste paper but a pulp sheet, since no substance corresponding to waste is contained, the classification unit 63 may be omitted from the configuration of the sheet manufacturing apparatus 100.

A supply opening 87 for supplying a resin which binds the fibers to each other is provided in the pipe 86. A resin supplying unit 88 supplies the resin in the air into the pipe 86 from the supply opening 87. That is, the resin supplying unit 88 supplies the resin on a path of the fiber material from the classification unit 63 toward the disentanglement unit 70. There is no particular limitation to the resin supplying unit 88 as long as the resin is supplied into the pipe 86; however, a screw feeder, a circle feeder, or the like is used as the resin supplying unit 88. The resin supplied from the resin supplying unit 88 is a resin for binding the plurality of fibers. At a point in time when the resin is supplied into the pipe 86, the plurality of fibers are in a state of not being bound to one another. The resin is a thermoplastic resin or a thermoset resin, may have a fiber shape, or may be powdery. An amount of the resin supplied from the resin supplying unit 88 is appropriately set depending on a type of sheet to be manufactured. In addition to the resin for binding the fibers, the resin supplying unit 88 may supply a colorant for coloring the fiber or an aggregation inhibitor for inhibiting aggregation of the fibers depending on a type of sheet to be manufactured. The resin supplying unit 88 may be omitted from the configuration of the sheet manufacturing apparatus 100.

The resin supplied from the resin supplying unit 88 is mixed with the fiber material which is classified by the classification unit 63, by the mixing unit 30 provided in the pipe 86. The mixing unit 30 mixes the fiber material and the resin and performs the transport thereof to the disentanglement unit 70.

The disentanglement unit 70 disentangles the fiber material which is entangled. Further, the disentanglement unit 70 disentangles the entangled resin in a case where the resin supplied from the resin supplying unit 88 has the fiber shape. In addition, the disentanglement unit 70 accumulates the fiber material or the resin uniformly in the accumulation unit 75 to be described below. That is, the word, "disentangle", means both an action of disentangling the entangled substance into pieces and an action of a uniform accumulation. When there is no entangled substance, the disentanglement unit 70 performs the action of the uniform accumulation. A sieve is used as the disentanglement unit 70. The disentanglement unit 70 is a rotating sieve in which a net section rotates by a motor (not illustrated). Here, the "sieve" used as the disentanglement unit 70 may not have a function of selecting a specific target object. This means that the "sieve" used as the disentanglement unit 70 has the net section with a plurality of openings and the disentanglement unit 70 may discharge the entire fiber material and resin guided into the disentanglement unit 70 to the outside from the openings. The disentanglement unit 70 may be omitted from the configuration of the sheet manufacturing apparatus 100.

In a state in which the disentanglement unit 70 rotates, the mixture of the fiber material and the resin is guided into the inside the disentanglement unit 70 formed of a cylindrical net section from the guiding-in opening 71. The mixture guided into the disentanglement unit 70 travels to the side of the net section by the centrifugal force. As described above, in some cases, the mixture guided into the disentanglement unit 70 contains the entangled fiber or resin and then, the entangled fiber or resin are disentangled in the air through the rotating net section. Then, the disentangled fiber or resin passes through the openings.

The fiber material and resin which passed through the openings of the disentanglement unit 70 are accumulated in the accumulation unit 75. The accumulation unit 75 is positioned under the disentanglement unit 70 and causes the fiber material and resin which passed through the openings of the disentanglement unit 70 to be accumulated on a first transport belt 76 such that a web W (accumulated material) is formed.

The first transport unit 79 has the first transport belt 76 and a stretching roller 77 and transports the web W. The first transport belt 76 stretched by the stretching roller 77 is an endless mesh belt in which a mesh is formed. The first transport belt 76 travels (circles around) by the rotation of the stretching roller 77. The fiber material and the resin are continuously dropped and accumulated from the disentanglement unit 70 while the first transport belt 76 continuously travels and thereby, the web W having a uniform thickness is formed on the first transport belt 76.

A suction device 78 that sucks the accumulated material downward is provided below the disentanglement unit 70 interposing the first transport belt 76 (the accumulation unit 75) therebetween. The suction device 78 produces an air current (air current which travels toward the accumulation unit 75 from the disentanglement unit 70) which is directed vertically downward. In this way, it is possible to suck in the fiber material and the resin dispersed in the air and thus, to increase a discharge speed from the disentanglement unit 70. As a result, it is possible to increase productivity of the sheet manufacturing apparatus 100. In addition, it is possible to form a downflow in a dropping path of the fiber material and the resin by the suction device 78 and thus, to prevent the fiber materials or the resins from entangling with each other during the dropping.

The second transport unit 40 transports, toward the pressurizing unit 50, the web W that is formed on the first transport belt 76 and is transported by the first transport unit 79. The second transport unit 40 transports the web W while sucking the web W vertically upward (a direction in which the web W is separated from the first transport belt 76). In addition, the second transport unit 40 is disposed to be spaced from the first transport unit 79 (the first transport belt 76) vertically upward (a direction perpendicular to the surface of the web W) and is disposed with a part thereof shifted on the downstream side from the first transport unit 79 (the first transport belt 76) in the transport direction of the web W. A transport zone of the second transport unit 40 becomes a zone from a stretching roller 77*a* on the downstream side of the first transport unit 79 to the pressurizing unit 50. A supplementary member 60 that guides the web W is disposed in the transport zone of the second transport unit 40. The supplementary member 60 will be described below in detail.

Figure 2:
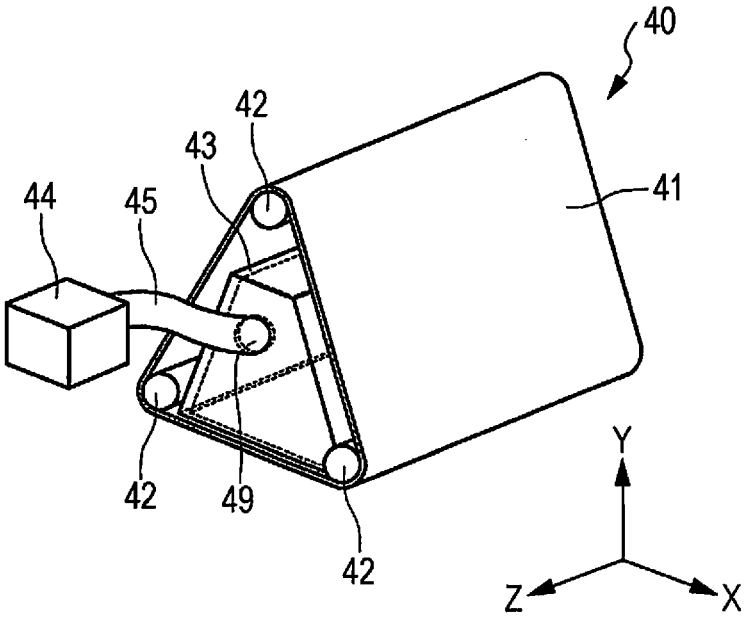
FIG. 2 is a perspective view schematically illustrating a second transport unit.

The second transport unit 40 includes a second transport belt 41, a stretching roller 42, a suction chamber 43, and a suction unit (refer to FIG. 2). The second transport belt 41 stretched by a stretching roller 42 is an endless mesh belt in which a mesh is formed.

The suction chamber 43 is positioned on the inner side of the second transport belt 41 and the inner space of the suction chamber 43 is sucked by the suction unit that produces the air current (suction force) such that the web W is adsorbed onto the second transport belt 41. That is, the suction unit and the suction chamber 43 produce the air current directed vertically upward from the first transport belt 76, thereby sucking the web W upward, and adsorb the web W onto the second transport belt 41. The second transport belt 41 travels (circles around) by the rotation of the stretching roller 42 and transports the web W. The stretching roller 42 rotates such that the second transport belt 41 travels at the same speed as that of the first transport belt 76. When there is a difference between the speeds of the first transport belt 76 and the second transport belt 41, the web W is stretched to end up breaking or buckling, which may be prevented at the same speed.

A part of the suction chamber 43 is overlapped with the first transport belt 76 (the part of the suction chamber 43 and the first transport belt 76 face each other) when viewed upward and, since the suction chamber 43 is disposed at a position on the downstream side which is not overlapped with the suction device 78, the web W on the first transport belt 76 is peeled off from the first transport belt 76 at a position facing the suction chamber 43 and is adsorbed onto the second transport belt 41.

The pressurizing unit 50 is configured of a pair of pressurizing rollers and the web W transported by the second transport unit 40 is nipped between the rollers and is pressurized. The heating unit 52 is disposed on the downstream side of the pressurizing unit 50, is configured of a pair of heating rollers, and heats and pressurizes the web W by nipping the web W between the rollers. The web W which is the accumulated material formed by accumulation of the fiber material and the resin is heated and pressurized by passing through the pressurizing unit 50 and the heating unit 52. The heating causes the resin to function as a binding agent so as to bind the fibers to each other and, by the pressurizing, a sheet P is shaped to be thin and to have a smooth surface.

As the cutting unit 90 that cuts the sheet P, a first cutting section 90*a* that cuts the sheet P in a direction intersecting with a transport direction of the sheet P and a second cutting section 90*b* that cuts the sheet P along the transport direction of the sheet P are disposed on the downstream side of the heating unit 52. The first cutting section 90*a* has a cutter and cuts the long-continuous sheet P to a sheet shape in accordance with cutting positions set to have a predetermined length therebetween. The second cutting section 90*b* has a cutter and cuts the sheet P to a sheet shape in accordance with a predetermined cutting position in the transport direction of the sheet P. In this way, a sheet with a desired size is formed. The cut sheets P are loaded in a stacker 95 or the like. A configuration may be employed, in which the sheet P is not cut, but is rolled by a winding roller in a continuous shape. As above, it is possible to manufacture the sheet P.

FIG. 2 is a perspective view schematically illustrating the second transport unit 40. As illustrated in FIG. 2, the suction chamber 43 disposed on the inner side of the second transport belt 41 has a hollow of a box shape which has a top surface and four side surfaces that are in contact with the top surface and the bottom (facing a lower surface of the second transport belt 41) is opened.

The two side surfaces of the four side surfaces of the suction chamber 43 face the second transport belt 41. An opening 49 that communicates with a pipe 45 is provided on at least one of the two side surfaces which do not face the second transport belt 41. The suction unit 44 (blower) and the suction chamber 43 are connected to each other via the pipe 45. The air inside the suction chamber 43 is sucked to the suction unit 44 via the pipe 45 and the air flows in from the bottom of the suction chamber 43. In this way, an air current directed upward (a +Y axial direction in the drawings) is produced and it is possible to suck the web W upward (the web W is adsorbed onto the second transport belt 41). In an example illustrated in FIG. 2, since ends of a part of the side surfaces of the suction chamber 43 are in contact with the stretching rollers 42, a brush-like sealing material is provided at the ends. In this way, the air is suppressed not to flow in from a gap between the ends and the stretching rollers 42. In addition, in this way, it is possible to lengthen a zone in which the suction is performed, in the transport direction of the web W.

2. Technique of Embodiment

Next, a technique of the embodiment will be described with reference to the drawings.

2-1. First Technique

Figure 3:
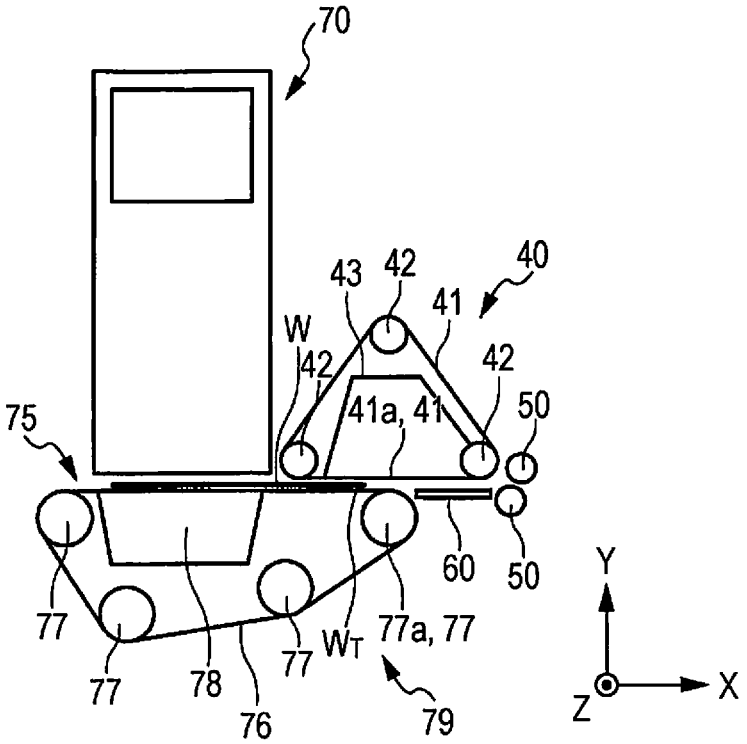
FIG. 3 is a view schematically illustrating a first transport unit and the second transport unit.

FIG. 3 is a view schematically illustrating the first transport unit 79 and the second transport unit 40.

As described above, since the fiber material and the resin is continuously dropped and accumulated on the traveling first transport belt 76 and thereby, the web W is formed, a tip-end portion $W_T$ of the web is shaped to be thin. Even when the thin portion of the web is sucked, sufficient static pressure is not applied to the portion because air intake through the web is increased. Therefore, although the tip-end portion $W_T$ of the web reaches a zone in which the first transport belt 76 faces the suction chamber 43, the tip-end portion $W_T$ of the web is unlikely to be adsorbed onto the second transport belt 41. In addition, the tip-end portion $W_T$ of the web is unlikely to be peeled off by the curvature in the vicinity of the stretching roller 77*a* because rigidity of the web is low and the web is unlikely to be peeled off from the first transport belt 76.

Further, when it is considered that the supplementary member 60 is not provided in a transport zone (zone from the stretching roller 77*a* to the pressurizing unit 50) of the second transport unit 40, the suction force of the suction chamber 43 is greater in the transport zone of the second transport unit 40 and is smaller in a zone (hereinafter, referred to as a facing zone) in which the suction chamber 43 faces the first transport belt 76. This is because the air intake is greatly performed in the zone of the second transport unit 40 due to lower resistance during the air intake and easier air intake in the transport zone of the second transport unit 40 than in the facing zone. Therefore, in the facing zone, the static pressure for peeling off the web W from the first transport belt 76 is insufficient and the tip-end portion $W_T$ of the web is unlikely to be adsorbed onto the second transport belt 41.

In the sheet manufacturing apparatus 100 of the embodiment, the supplementary member 60 is provided in the transport zone of the second transport unit 40 and thus, an amount of the air intake is decreased in the transport zone (pressure loss is great). In this way, the static pressure applied to the web W in the facing zone is increased (the suction force is increased in the facing zone). Accordingly, in the facing zone, the tip-end portion $W_T$ of the web is likely to be peeled off from the first transport belt 76 and it is possible to easily adsorb the web W onto the second transport belt 41. In addition, the supplementary member 60 is provided in the transport zone of the second transport unit 40 such that the supplementary member 60 can receive the web W peeled off from the second transport belt 41 (prevent the web W from dropping in the transport zone) even in a case where the apparatus stops during the transport of the web W and there is no suction force of the second transport unit 40. The supplementary member 60 has a flat plate shape without an opening such as a hole. In addition, it is desirable that there is no protrusion on the surface of the supplementary member 60 which faces the second transport belt 41.

A position of the supplementary member 60 in the transport direction of the web W (the X axial direction in the drawings) is a position on the downstream side from the first transport unit 79 and may be a position facing the suction chamber 43. In addition, a position of the supplementary member 60 in a direction orthogonal to the surface of the web W (the Y axial direction in the drawings) is a position which is spaced downward from a transport surface 41*a* (surface on which the suction and transport of the web W of the second transport unit 40 are performed) of the lower second transport belt and may be a position facing the suction chamber 43 and is a position on which the suction force of the suction chamber 43 has an influence and may be a position which is spaced farther from the transport surface 41*a* of the second transport belt than the thickness of the web W.

In addition, in order to increase an amount of reduction of the amount of the air intake in the transport zone, it is preferable that the supplementary member 60 is greater in size than the suction chamber 43 along the surface of the web W in a direction orthogonal to the transport direction of the web W (the Z axial direction in the drawings). In addition, it is preferable that a downstream-end of the supplementary member 60 in the transport direction of the web W extends to a position facing the downstream-end of the suction chamber 43.

2-2. Second Technique

Figure 4:
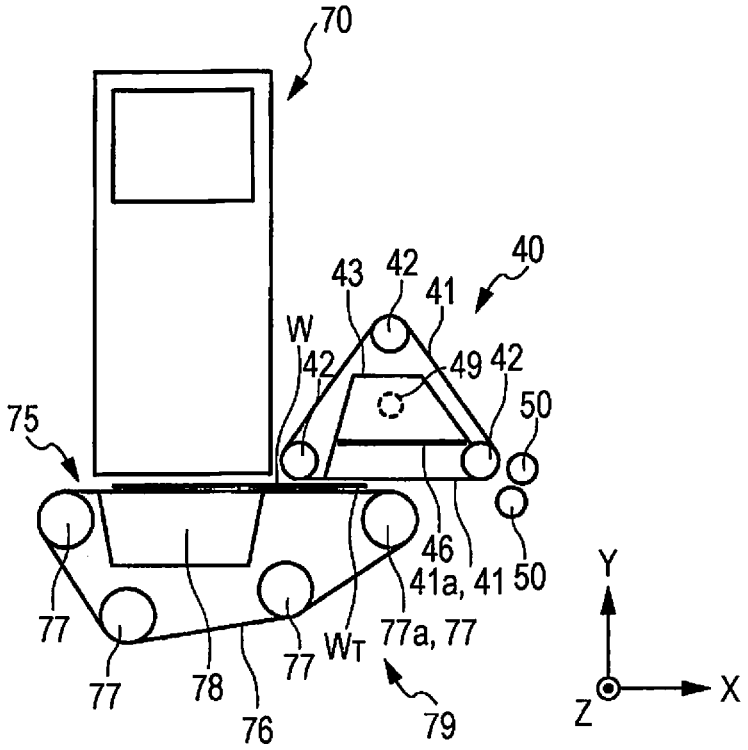
FIG. 4 is a view schematically illustrating the first transport unit and the second transport unit.

As illustrated in FIG. 4, a current plate 46 is provided in the suction chamber 43 and thereby, the decrease of the amount of air intake may be performed in the transport zone of the second transport unit 40.

The current plate 46 has a plate shape in which a plurality of holes are formed on the surface thereof and is disposed at a position between the transport surface 41*a* of the lower second transport belt and the opening 49 in the suction chamber 43 such that the surface having the holes is substantially parallel to the surface of the transport surface 41*a* of the second transport belt. In addition, an end of the current plate 46 is in contact with the side surfaces of the suction chamber 43. In addition, in the current plate 46, the holes on the upstream side (side in a −X axial direction in the drawings) are greater in size than the holes on the downstream side (the +X axial direction in the drawings) in the transport direction of the web.

Figure 5:
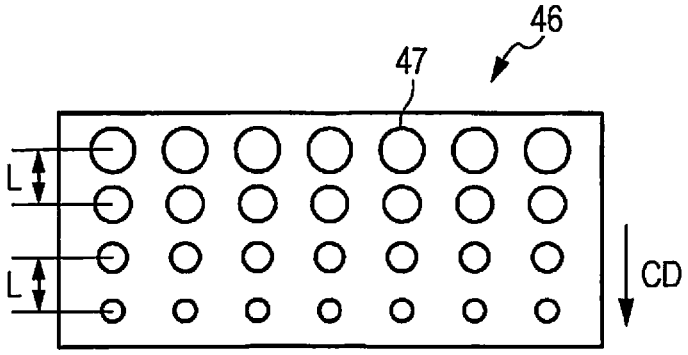
FIG. 5 is a view schematically illustrating a current plate.

FIG. 5 is a view schematically illustrating an example of the current plate 46. In the current plate 46 illustrated in FIG. 5, a plurality of round holes 47 are provided and the diameter of the holes 47 on the upstream side of a transport direction CD is greater than the diameter of the holes 47 on the downstream side of the transport direction CD. In an example illustrated in FIG. 5, a pitch L of the holes 47 in the transport direction CD (center-to-center distance of the holes 47 adjacent to each other in the transport direction CD) is constant; however, a pitch L of the holes 47 on the upstream side may be less than a pitch L of the holes 47 on the downstream side. In addition, a shape of the holes 47 is not limited to the circle, but may be rectangular or polygonal, or may be a slit shape.

As above, the current plate 46 is provided in the suction chamber 43 and may be configured to have the holes 47 on the upstream side greater in size than the holes 47 on the downstream side on the surface of the current plate 46. Otherwise, similar to a case where the supplementary member 60 is provided, the amount of the air intake is decreased in the transport zone (downstream side) of the second transport unit 40 and it is possible to increase the static pressure applied to the web W in the facing zone (upstream side) and thereby, it is possible for the tip-end portion $W_T$ of the web to be easily peeled off from the first transport belt 76 and to be easily adsorbed onto the second transport belt 41 in the facing zone.

2-3. Third Technique

Figure 6:
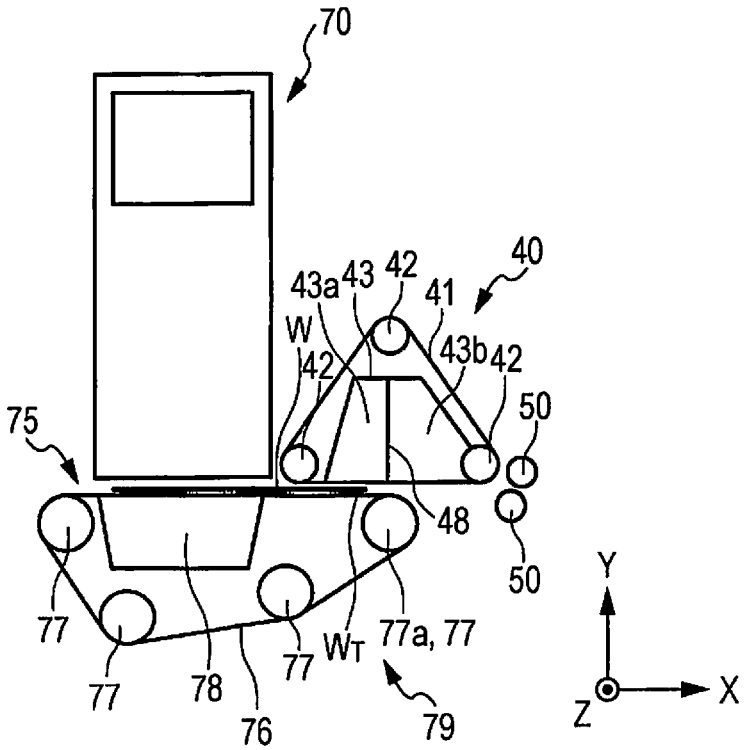
FIG. 6 is a view schematically illustrating a first transport unit and a second transport unit.

As illustrated in FIG. 6, the suction chamber 43 is divided into a plurality of suction regions in the transport direction of the web W, has a configuration in which the suction of each of the plurality of suction regions is controllable separately, and may be controlled such that the suction is started earlier in the suction region on the upstream side in the transport direction of the web W when the transport of the web W is started.

In an example in FIG. 6, the suction chamber 43 is divided into a first suction region 43*a* on the upstream side and a second suction region 43*b* on the downstream side by a partition wall 48 provided in the suction chamber 43. The first suction region 43*a* faces the first transport belt 76 (corresponding to the facing zone) and the second suction region 43*b* corresponds to the transport zone of the second transport unit 40. In this case, after starting the transport of the web W, the first suction region 43*a* starts suction when the tip-end portion $W_T$ of the web reaches the upstream end of the facing zone (or, from the very beginning of the transport of the web W) and the second suction region 43*b* starts suction when (or, immediately before) the tip-end portion $W_T$ of the web passes the facing zone and reaches the upstream end of the transport zone of the second transport unit 40. The suction of the first suction region 43*a* continues to be performed when the suction of the second suction region 43*b* is started. For example, the position of the tip-end portion $W_T$ of the web is detected by a sensor provided above the first transport belt 76 and it is possible to detect that the tip-end portion $W_T$ of the web reaches the facing zone or the transport zone based on the detected position.

Figure 7:
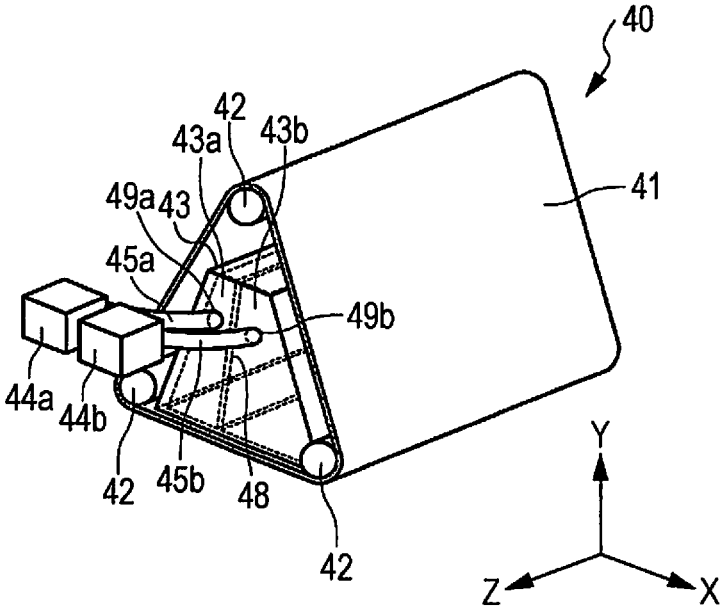
FIG. 7 is a perspective view schematically illustrating still a second transport unit.

FIG. 7 is a perspective view schematically illustrating the second transport unit 40 in FIG. 6. In an example illustrated in FIG. 7, the suction units 44 (44*a* and 44*b*) are connected to the first suction region 43*a* and the second suction region 43*b*, respectively. An opening 49*a* through which a pipe 45*a* communicates is provided on the side surface of the first suction region 43*a* and an opening 49*b* through which a pipe 45*b* communicates is provided on the side surface of the second suction region 43*b*. The suction unit 44*a* is connected to the first suction region 43*a* via the pipe 45*a* and the suction unit 44*b* is connected to the second suction region 43*b* via the pipe 45*b*. In this case, when the transport of the web W is started, first, a suction operation of the suction unit 44*a* is started and then, the suction of the first suction region 43*a* is started. Next, a suction operation of the suction unit 44*b* is started and then, the suction of the second suction region 43*b* is started.

As above, the suction chamber 43 is divided into the plurality of suction regions. When the transport of the web W is started, the suction of the first suction region 43*a* facing the facing zone (on the upstream side) is started earlier than the suction regions on the downstream side and thereby it is possible to reliably peel off the tip-end portion $W_T$ of the web from the first transport belt 76 and adsorb the web onto the second transport belt 41 in the facing zone regardless of the amount of the air intake in the transport zone of the second transport unit 40. In addition, the suction chamber 43 is divided into the plurality of suction regions and has the plurality of suction units 44 and thereby, the suction of the first suction region 43*a* is secured. Therefore, there is no problem even when the suction of the second suction region 43*b* is performed at the same time.

Figure 8:
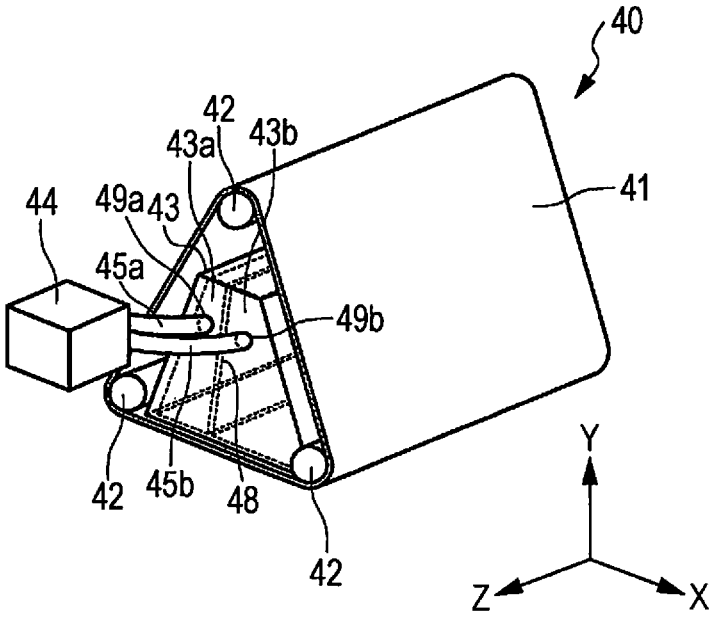
FIG. 8 is a perspective view schematically illustrating still a second transport unit.

As illustrated in FIG. 8, a configuration may be employed, in which the suction of the first suction region 43*a* and the suction of the second suction region 43*b* are performed by one suction unit 44. In an example illustrated in FIG. 8, the pipe 45*a* and the pipe 45*b* are connected to the suction unit 44. In addition, a magnetic valve (not illustrated) is provided on the pipe 45*b* and the pipe 45*b* is configured to be openable and closable. In this case, when the transport of the web W is started, the suction operation of the suction unit 44 is started, in a state in which the pipe 45 is closed, and thereby, the suction of the first suction region 43*a* is started. Next, the pipe 45*b* is opened and thereby, the suction of the second suction region 43*b* is started. In this way, it is possible to increase the suction force (suction force at the very beginning of the transport) of the first suction region 43*a*, in a state in which the pipe 45*b* is closed, by twice the suction force of the first suction region 43*a* in a state in which the pipe 45*b* is opened and it is possible to reliably adsorb the tip-end portion $W_T$ of the web.

3. Modification Example

The invention includes practically the same configuration (configuration having the same function, method, and effect or configuration having the same object and effect) as the configuration described in the embodiments. In addition, the invention contains a configuration in which a non-essential part of the configuration described in the embodiments is substituted. In addition, the invention includes a configuration which achieves the same operation effects as the configuration described in the embodiments or a configuration in which it is possible to achieve the same object. In addition, the invention includes a configuration obtained by applying a known technology to the configuration described in the embodiments.

In the second technique and the third technique, the supplementary member 60 is not used; however, the supplementary member 60 may be provided. For example, the supplementary member 60 is able to receive the web W and prevent the web W from dropping in a case where the apparatus stops abruptly and the suction unit 44 stops. Otherwise, each technique or each drawing may be combined.

A sheet manufactured by the sheet manufacturing apparatus 100 mainly indicates a sheet-shaped one. However, the sheet is not limited to the sheet-shaped one, but may be board-shaped or web-shaped. The sheet in this specification is divided into paper and nonwoven fabric. The paper includes an aspect or the like in which pulp or waste paper as a raw material is formed into a thin sheet shape and includes recording paper used for writing or printing, wallpaper, wrapping paper, colored paper, drawing paper, Kent paper, or the like. The nonwoven fabric is a thicker one or one having lower strength than the paper and includes common nonwoven fabric, fiberboard, tissue paper, kitchen paper, a cleaner, a filter, a liquid absorber, a sound absorber, a cushioning material, a mat or the like. Examples of the raw material may include a plant fiber such as cellulose, a chemical fiber such as polyethylene terephthalate (PET) or polyester, or an animal fiber such as wool or silk.

In addition, a moisture sprayer for spraying and adding moisture to the accumulated material accumulated in the accumulation unit 75 may be provided. In this way, it is possible to achieve high strength of a hydrogen bond when the sheet P is shaped. The moisture is sprayed is added to the accumulated material before passing through the heating unit 52. Starch, polyvinyl alcohol (PVA) or the like may be added to water moisture which is sprayed by the moisture sprayer. In this way, it is possible to increase strength of the sheet P.

The crushing unit 10 may not be provided in the sheet manufacturing apparatus 100. For example, when the raw material is obtained by being crushed by an existing shredder or the like, there is no need to use the crushing unit 10.

In addition, in the above embodiments, a case where the invention is applied to a dry-type sheet manufacturing apparatus is described; however, the invention may be applied to a wet-type sheet manufacturing apparatus.

The entire disclosure of Japanese Patent Application No. 2014-044766, filed Mar. 7, 2014 is expressly incorporated by reference herein.

What is claimed is:

1. A sheet manufacturing apparatus that forms a sheet using a web, the apparatus comprising:

an accumulation unit that accumulates the web containing at least a fiber on a first transport belt;

a first transport unit that causes the first transport belt to circle around so as to transport the web;

a second transport unit that is spaced from the first transport unit in a perpendicular direction perpendicular to a surface of the web, is disposed with a part thereof shifted from the first transport unit toward the downstream side in a transport direction of the web, and sucks the web in a direction in which the web is spaced from the first transport belt and transports the web, the second transport unit including a suction unit that generates a suction force to suction the web, a second transport belt that circles around, a plurality of rollers on which the second transport belt is wounded and which are configured to rotate so as to move the second transport belt, and a suction chamber which is positioned in an inner side of the second transport belt circling around and of which an inner space is sucked by the suction unit such that the web is adsorbed onto the second transport belt, the suction chamber having at least a first part facing the first transport belt and a second part overlapping, in the perpendicular direction, one of the rollers of the second transport unit, the one of the rollers of the second transport unit being disposed most downstream in the transport direction among the rollers of the second transport unit; and a pair of rollers that nips and transports the web, the pair of the rollers being disposed downstream in the transport direction relative to the second transport belt and spaced apart from the second transport belt such that the web is transferred from the second transport belt to the pair of the rollers.

2. The sheet manufacturing apparatus according to claim 1, further comprising:

a supplementary member that supplements the suction force and is disposed at a position which faces and is spaced from a surface of the second transport unit at which suction of the web is performed, on which the suction force has an influence, and which is spaced farther from the surface than a thickness of the web, on the downstream side from the first transport unit in the transport direction of the web.

3. The sheet manufacturing apparatus according to claim 2, wherein the supplementary member is greater in size than the suction chamber along the surface of the web in a direction orthogonal to the transport direction of the web.

4. The sheet manufacturing apparatus according to claim 1, wherein the suction chamber has a plurality of holes on a surface facing the first transport unit, and wherein the hole on the upstream side is greater in size than the hole on the downstream side in the transport direction of the web.

5. The sheet manufacturing apparatus according to claim 1, wherein the suction chamber is divided into a plurality of suction regions in the transport direction of the web, wherein the suction of the suction regions is controllable separately, and wherein, when the transport of the web is started, the suction is started earlier in the suction region farther on the upstream side in the transport direction of the web than in the suction region farther on the downstream side.

6. The sheet manufacturing apparatus according to claim 5, wherein a plurality of the suction units are connected to the plurality of suction regions, respectively and wherein, when the transport of the web is started, the suction is started earlier by the suction unit corresponding to the suction region farther on the upstream side in the transport direction of the web than by the suction unit corresponding to the suction region farther on the downstream side.

7. A sheet manufacturing apparatus that forms a sheet using a web, the apparatus comprising:

an accumulation unit that accumulates the web containing at least a fiber on a first transport belt;

a first transport unit that includes the first transport belt and that causes the first transport belt to circle around so as to transport the web in a transport direction; and a second transport unit spaced apart from the first transport unit in a perpendicular direction perpendicular to the transport direction and a surface of the web, the second transport unit being disposed with a part thereof shifted from the first transport unit toward a downstream side in the transport direction, the second transport unit sucking the web in the perpendicular direction and transporting the web, the second transport unit including a suction unit that generates a suction force to suction the web in the perpendicular direction, a second transport belt that circles around and defines a surface on which the web is transferred, the surface having a first portion disposed so as to overlap the first transport belt as viewed in the perpendicular direction and having a second portion that is different from the first portion and does not overlap the first transport belt as viewed in the perpendicular direction, and a suction chamber which is positioned in an inner side of the second transport belt circling around and of which an inner space is sucked by the suction unit such that the web is adsorbed onto the second transport belt, the suction chamber facing the first transport belt; and a supplementary member that supplements the suction force, the supplementary member being a plate-shaped member disposed downstream in the transport direction relative to the first transport belt, the supplementary member facing the second portion of the surface of the second transport unit in the perpendicular direction and disposed apart from the second portion in the perpendicular direction such that the supplementary member and the second portion define a passage through which the web is transported.

8. The sheet manufacturing apparatus according to claim 7, wherein the supplementary member is disposed so as to overlap the suction chamber as viewed in the perpendicular direction.

* * * * *